US009854853B2

(12) United States Patent
Musciacchio

(10) Patent No.: US 9,854,853 B2
(45) Date of Patent: Jan. 2, 2018

(54) SWIM SUIT, PARTICULARLY FOR COMPETITION SWIMMING

(75) Inventor: Giuseppe Musciacchio, Tolentino (IT)

(73) Assignee: Arena Distribution S.A., Lugano (CH)

( * ) Notice: Subject to any disclaimer, the term of this patent is extended or adjusted under 35 U.S.C. 154(b) by 373 days.

(21) Appl. No.: 14/415,171

(22) PCT Filed: Jul. 25, 2012

(86) PCT No.: PCT/IB2012/053794

§ 371 (c)(1),
(2), (4) Date: Jan. 16, 2015

(87) PCT Pub. No.: WO2014/016643

PCT Pub. Date: Jan. 30, 2014

(65) Prior Publication Data

US 2015/0201682 A1 Jul. 23, 2015

(51) Int. Cl.

| | |
|---|---|
| ***A41D 5/00*** | (2006.01) |
| ***A41D 7/00*** | (2006.01) |
| ***D03D 15/08*** | (2006.01) |
| ***D03D 17/00*** | (2006.01) |

(52) U.S. Cl.

CPC ..... *A41D 7/00* (2013.01); *A41D 7/005* (2013.01); *D03D 15/08* (2013.01); *D03D 17/00* (2013.01); *A41D 2400/24* (2013.01); *A41D 2400/38* (2013.01); *A41D 2400/82* (2013.01); *A41D 2500/20* (2013.01); *A41D 2600/10* (2013.01); *D10B 2101/12* (2013.01)

(58) Field of Classification Search

CPC ..... A41D 7/00; A41D 1/08; B63C 11/04

USPC ..... 2/67, 228, 238, 2.15, 82

See application file for complete search history.

(56) References Cited

U.S. PATENT DOCUMENTS

| | | | | |
|---|---|---|---|---|
| 2,075,387 A * | 3/1937 | Daniel | A41D 7/00 | 2/67 |
| 3,436,762 A * | 4/1969 | Cahan | A41D 7/00 | 2/238 |
| 5,033,116 A * | 7/1991 | Itagaki | A41D 7/00 | 114/67 R |
| 5,809,567 A * | 9/1998 | Jacobs | A41D 7/00 | 2/1 |
| 6,526,584 B1 * | 3/2003 | Hunter | A41D 13/012 | 2/2.15 |
| 7,361,618 B2 * | 4/2008 | Homma | B29C 70/22 | 442/149 |

(Continued)

FOREIGN PATENT DOCUMENTS

WO WO 2007/059552 A1 5/2007

OTHER PUBLICATIONS

Arena natation: "Arena Powerskin Carbon Pro—Les spécialistes nous expliquent tout", Retrievable from the Internet: URL: https://www.youtube.com/watch?v=sqp96IJM1Wg Apr. 17, 2012, p. 1.

(Continued)

*Primary Examiner* — Tejash Patel

(74) *Attorney, Agent, or Firm* — Blank Rome LLP

(57) ABSTRACT

A swim suit (1), particularly for competition swimming, comprising an outer shell (2) suitable to cover at least part of the body trunk and of the legs of a swimmer, wherein the outer shell (2) is made of a flexible stretchable fabric (3) and, in at least a region of the shell, carbon fibers are woven into the fabric.

14 Claims, 4 Drawing Sheets

(56) References Cited

U.S. PATENT DOCUMENTS

Figure 1:
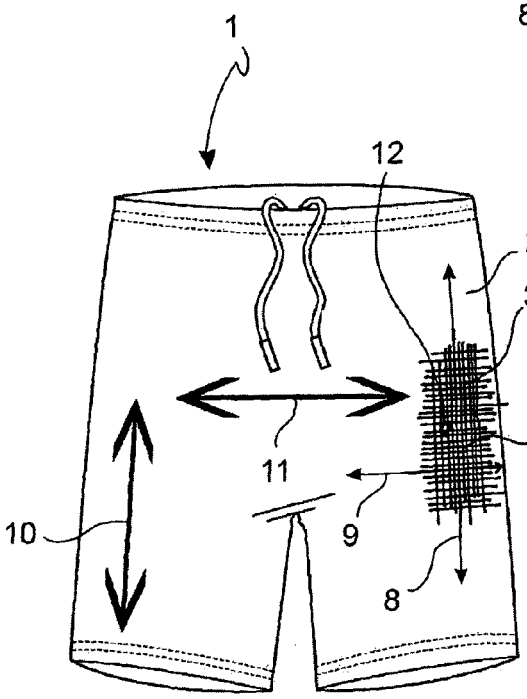

| | | | | |
|---|---|---|---|---|
| 2005/0198722 | A1* | 9/2005 | Nordstrom | A41D 7/00 2/67 |
| 2009/0181599 | A1* | 7/2009 | Farmer | A41B 17/00 450/39 |
| 2011/0271415 | A1* | 11/2011 | Torry | A41D 1/08 2/23 |
| 2013/0219579 | A1* | 8/2013 | Molyneux | B63C 11/04 2/2.15 |
| 2015/0107000 | A1* | 4/2015 | Tanaka | A41D 13/0015 2/227 |

OTHER PUBLICATIONS

M-C Prévitali et al.: "2012 le monde va changer, Arena, Powerskin carbon pro", Retrievable from the Internet: URL: http://ebookbrowse.com/dp-presse-powerskin-carbon-pro-bd-pdf-d340145935#.UWJym1vxUCc.email Feb. 29, 2012, pp. 1-9.

* cited by examiner

SWIM SUIT, PARTICULARLY FOR COMPETITION SWIMMING

The present invention relates, in general, to the field of sports garment. More particularly, it relates to swim suits or swim garments for water sports activities and particularly for competition swimming.

In the past years, in competitive swimming, very high levels of performance have been achieved thanks to evolved training methods and a specific nutrition which increasingly meet the requirements of the individual physical constitution of the athletes and of the swimming exercise to be performed.

On the other hand, in nearly all fields of sports and particularly in swimming, where the body of the athlete moves across a liquid, the efforts to enhance the performances increasingly focus on the development of sports garment which positively influences both the interaction of the athletes body surface with the environment and the physical conditions of the athlete during the competition or sports exercise and training.

The development of swim suits and garments focuses mainly on two principal goals, i.e. the reduction of friction between the external surface of the swim suit and the water and a hoop-compression of the muscular structure of the athlete in the region of the legs and body trunk.

In order to reduce the friction between the swimmer and the water, several stretchable fabrics with an extremely smooth and water repellent external surface texture (e.g. PTFE coated elastic textiles) have been proposed and successfully used. Moreover full-body swim suits have been developed in order to extend the beneficial hydrodynamic features of the smooth and water repellent fabric over nearly the entire body surface of the athlete.

The hoop-compression of the muscular structure of the swimmer has been aimed to by using swim suits made of stretchable garment material with a comparatively high coefficient of elasticity and by dressing the swimmer with such a small size of swim suit that the consequent stretching of the garment and resulting reaction hoop force result in a radial compression of the swimmer's body trunk and legs.

Of course, also to this end, the tendency towards full body swim garments contributed to extend the beneficial effect of the muscular compression (prevention of loose muscle totter and of the accumulation of lactic acid in the muscles) throughout the entire body of the swimmer. Even though the known swim suits provide generally satisfactory results, they still have some drawbacks regarding the athletes' muscle compression, the mechanical durability and wear resistance of the swim suit and to long term maintenance of the reversible stretch properties of the swim suit.

Hence there is still a need of improved swim garment which accomplishes an increased muscle compression without excessively pretensioning and predeforming the swim garment.

There is a further need to provide swim garment which has an improved long term durability, wear resistance and which maintains its reversible stretch properties over a long time notwithstanding the mechanical and physical-chemical conditions of use.

The object of the present invention is therefore to provide an improved swim suit which better addresses at least some of the described needs.

These and other objects are achieved by a swim suit according to the annexed claim 1.

Advantageous embodiments are the object of the dependent claims.

According to an aspect of the invention, a swim suit, particularly for competition swimming, comprises an outer shell suitable to cover at least part of the body trunk and of the legs of a swimmer, wherein the shell is made of a flexible stretchable fabric having, in at least a region of the shell, a non-linear tensile stress-strain behavior with:

- a base strain range in which the tensile strain of the fabric is smaller than a transition strain value, and
- an overstrain range in which the tensile strain of the fabric is greater than the transition strain value, wherein a tensile modulus of the fabric in the overstrain range is greater than a tensile modulus of the fabric in the base strain range.

According to a further aspect of the invention, a swim suit, particularly for competition swimming, comprises an outer shell suitable to cover at least part of the body trunk and of the legs of a swimmer, wherein the shell is made of a flexible stretchable fabric and, in at least a region of the shell, carbon fibers are woven into the fabric.

According to a yet further aspect of the invention, a swim suit, particularly for competition swimming, comprises an outer shell suitable to cover at least part of the body trunk and of the legs of a swimmer, wherein the shell is made of a flexible stretchable fabric and, in at least a region of the shell, additional reinforcement fibers are woven into the fabric in a multiple bent configuration such that:

- in a base strain range in which the tensile strain of the shell is smaller than a transition strain value, the reinforcement fibers bend or straighten out without elongation and without substantially contributing to the tensile stiffness of the shell,
- in an overstrain range in which the tensile strain of the shell is greater than the transition strain value, the reinforcement fibers are elongated and contribute to and increase the tensile stiffness of the shell compared to the base strain range.

The reinforcement fibers woven into the stretch fabric of the swim suit are stronger and stiffer than the base fibers, e.g. Lycra® fibres, of which the fabric is made. Such additional stiffness provides an enhanced support to the athlete by a strong muscle compression which, however, can be provided to act only beyond a preset transition strain value. Accordingly, at a comparatively little stretched shell of the swim suit, the latter allows for easy stretch and movement and, at high stretch (e.g. due to maximum muscle contraction), the reinforcement fibers, particularly carbon fibers "lock out" the fabric which becomes suddenly much stiffer and can accomplish the desired muscle compression in selected regions of the swim suit. A thus embodies competition swim suit reconciles the contrasting needs of freedom of movement and strong muscle compression during swimming.

These and other features and advantages of the present invention shall be made apparent from the accompanying drawings which illustrate embodiments of the invention, and, together with the general description of the invention given above, and the detailed description of the embodiments given below, serve to explain the principles of the present invention.

Figure 2:
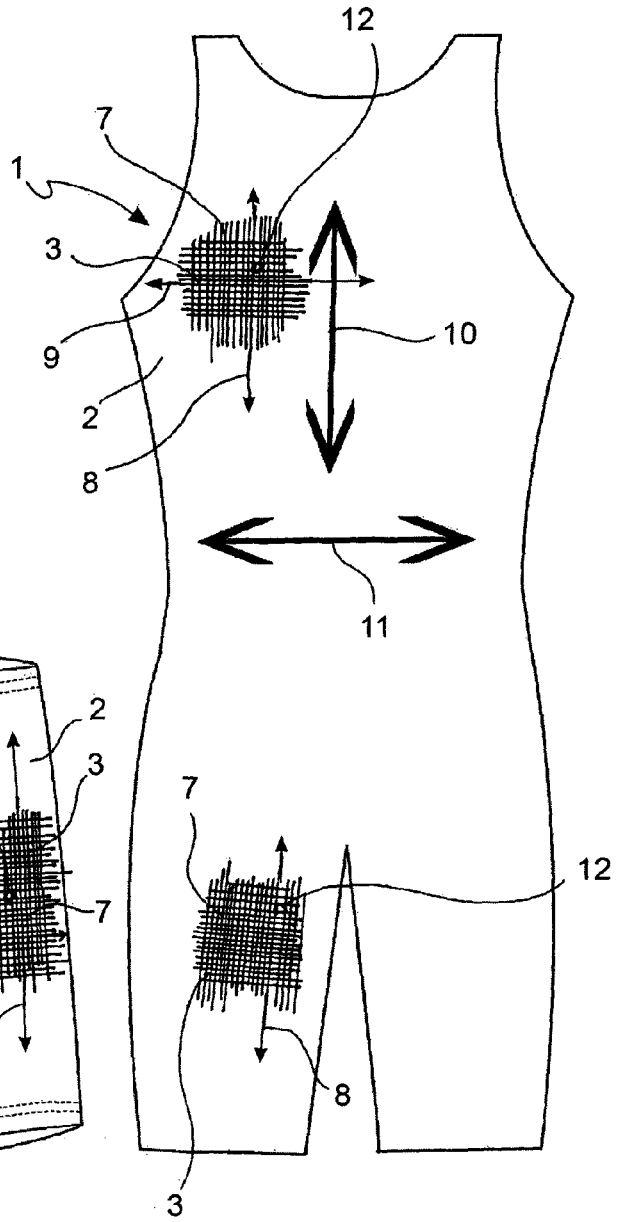
Figure 3:
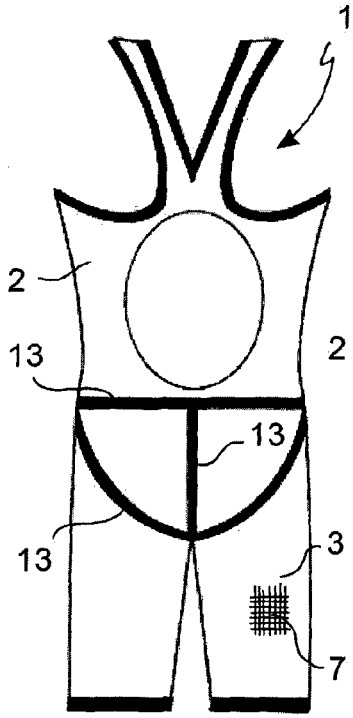
Figure 4:
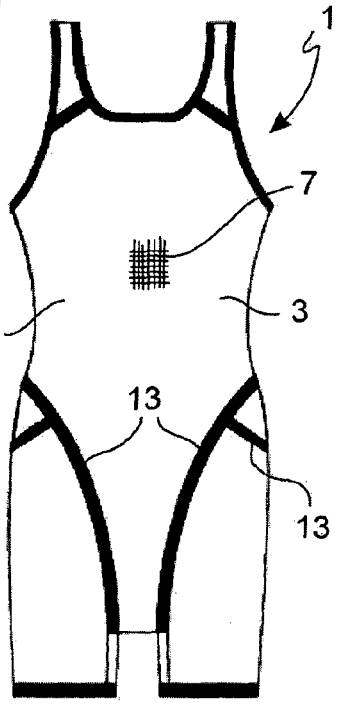
Figure 5:
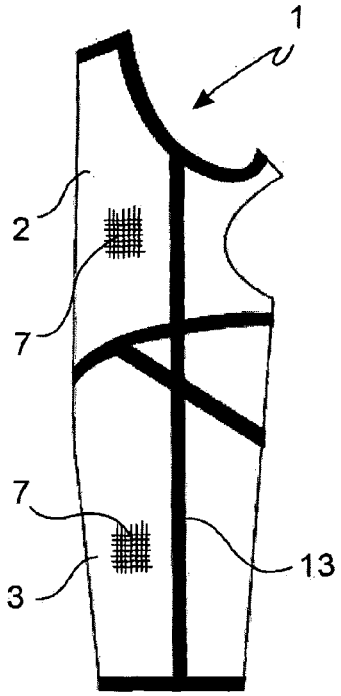
Figure 6:
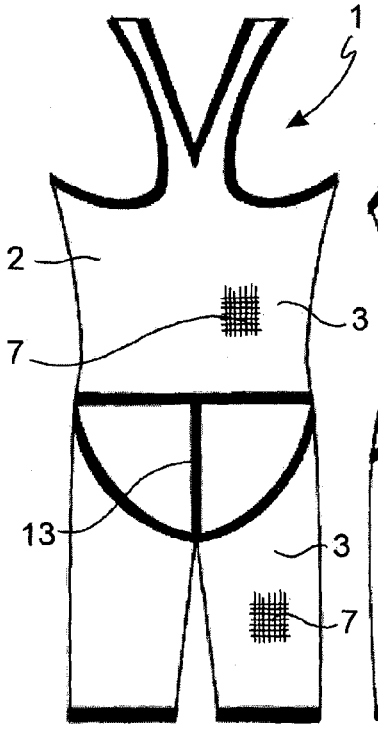
Figure 7:
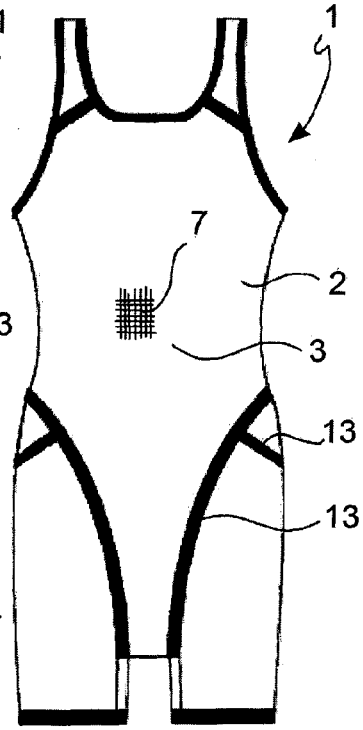
Figure 8:
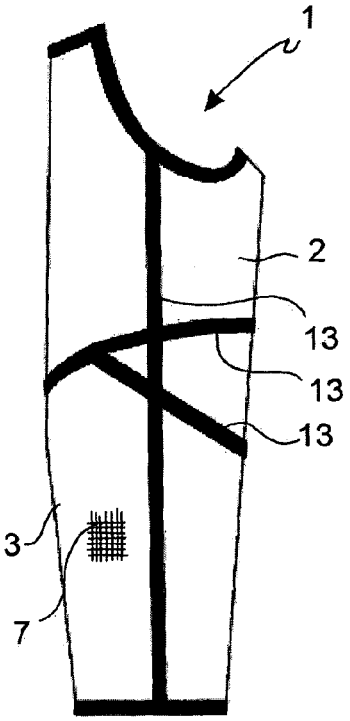
Figure 9:
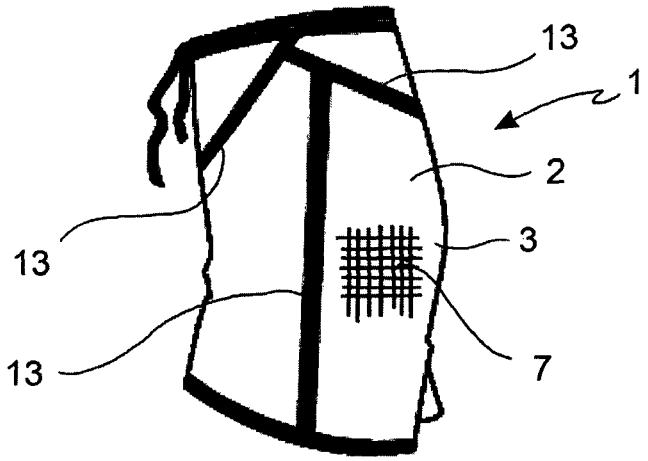
Figure 10:
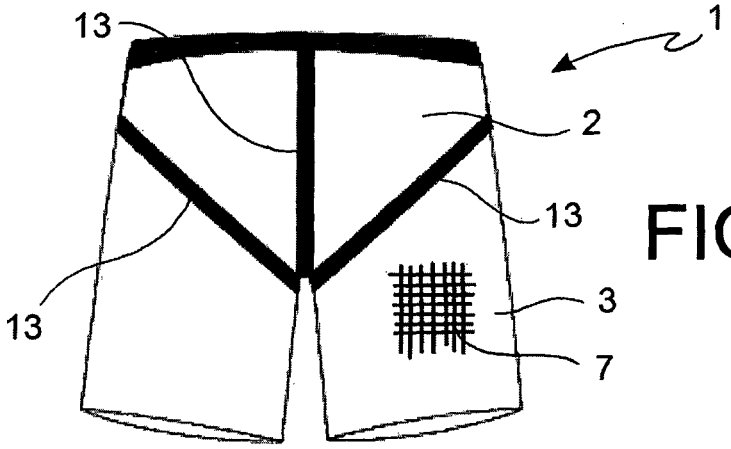
Figure 11:
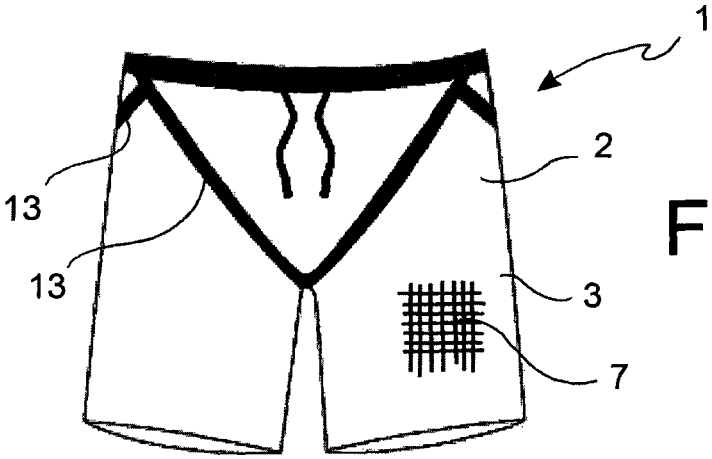
Figure 12:
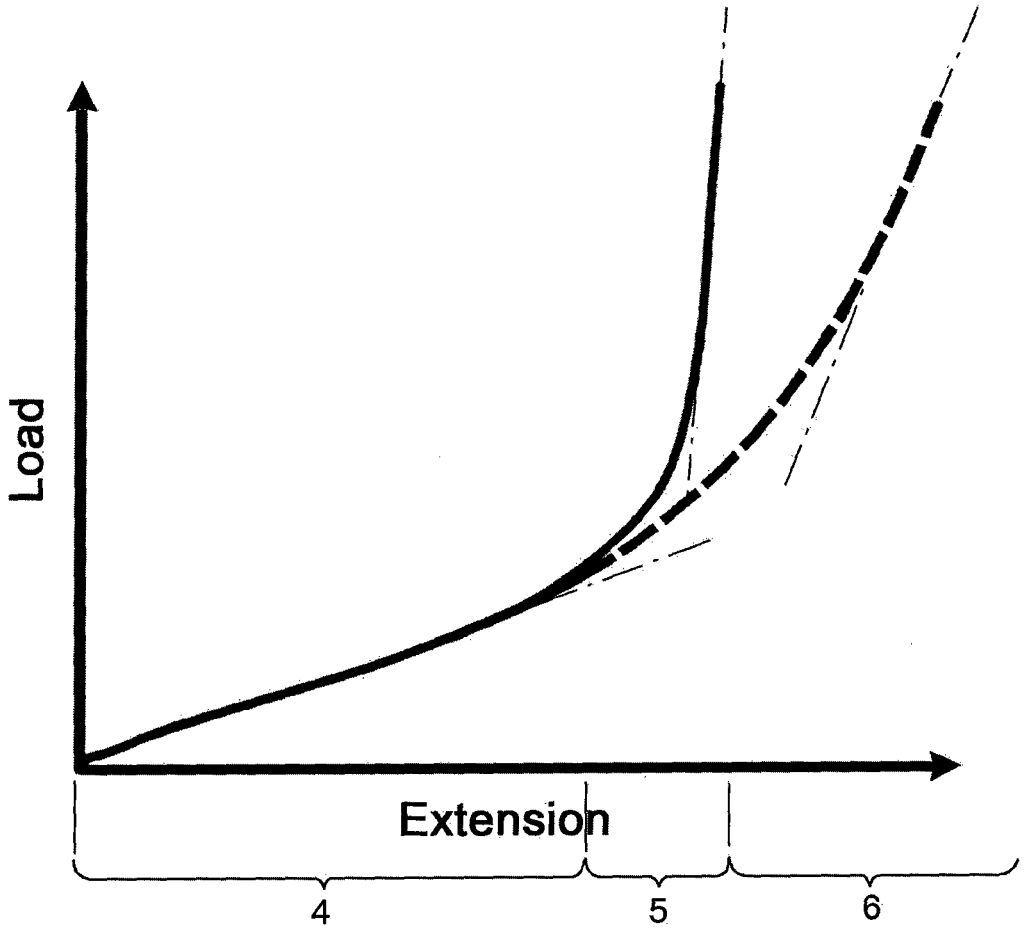

FIG. 1 illustrates a frontal view of a jammer style male swim suit according to an embodiment of the invention, FIG. 2 illustrates a frontal view of a tank-suit style one-piece female swim suit according to an embodiment of the invention, FIGS. 3, 4, 5 illustrate rear, front and side views of a tank-suit style one-piece female swim suit with back opening according to an embodiment of the invention, FIGS. 6, 7, 8 illustrate rear, front and side views of a tank-suit style one-piece female swim suit with closed back according to an embodiment of the invention, FIGS. 9, 10, 11 illustrate side, rear and front views of a jammer style male swim suit according to an embodiment of the invention, FIG. 12 shows an exemplary non-linear load-extension (or stress-strain) curve of a fabric of the swim suit in accordance with an embodiment.

With reference to the figures, a swim suit is generally denoted by reference numeral 1.

The swim suit 1, particularly for competition swimming, comprises an outer shell 2 suitable to cover at least part of the body trunk and of the legs of a swimmer, wherein the shell 2 is made of a flexible stretchable fabric 3 having, in at least a region of the shell 2, a non-linear tensile stress-strain behavior with:

- a base strain range 4 in which the tensile strain of the fabric 3 is smaller than a transition strain value 5, and
- an overstrain range 6 in which the tensile strain of the fabric 3 is greater than the transition strain value 5, wherein a tensile modulus (Young's modulus which expresses the material stiffness in terms of the tensile stress required for a 100% elongation of the material, [$N/mm^2$]) of the fabric 3 in the overstrain range 6 is greater than a tensile modulus of the fabric 3 in the base strain range 4.

In accordance with a further aspect of the invention, in at least a region of the shell 2, carbon fibers 7 are woven into the fabric 3.

In accordance with a further aspect of the invention, in at least a region of the shell 2, additional reinforcement fibers (which may be carbon fibers 7 or fibers made of a different material than carbon) are woven into the fabric 3 in a multiple bent configuration such that:

- in a base strain range 4 in which the tensile strain of the shell 2 is smaller than a transition strain value 5, the reinforcement fibers bend or straighten out without elongation (and, hence, without, axial fiber stress and strain) and without substantially contributing to the tensile stiffness of the shell 2,
- in an overstrain range 6 in which the tensile strain of the shell is greater than the transition strain value 5, the reinforcement fibers are elongated (with axial fiber stress and strain) and contribute to and increase the tensile stiffness of the shell 2 compared to the base strain range 4.

The reinforcement fibers, particularly carbon fibers 7, woven into the stretch fabric 3 of the swim suit 1 are stronger and stiffer than the base fibers, e.g. Lycra® fibers, of which the fabric 3 is made. Such additional stiffness provides an enhanced support to the athlete by a strong muscle compression which, however, can be provided to act only in response to shell stretch beyond the preset transition strain value 5. Accordingly, at a comparatively little stretched shell 2 of the swim suit 1, the latter allows for easy stretch and movement and, at high stretch (e.g. due to maximum muscle contraction), the reinforcement fibers, particularly carbon fibers 7 "lock out" the fabric 3 which becomes suddenly much stiffer and can accomplish the desired muscle compression in selected regions of the swim suit 1. A thus embodies competition swim suit reconciles the contrasting needs of freedom of movement and strong muscle compression during swimming.

In accordance with an embodiment, the reinforcement fibres, e.g. carbon fibers 7, are distributed in and woven into the fabric 3 in a manner that individual reinforcement fibres, e.g. carbon fibers 7, straighten out and undergo axial fiber strain at different overall strain values of the fabric 3, thereby determining a transition strain region in which the stretch stiffness, i.e. an overall tensile modulus of the fabric 3 gradually changes from a base tensile modulus (in the base strain range) to an overstrain tensile modulus (in the overstrain range). Of course, also in this embodiment, the overstrain tensile modulus of the fabric 3 is greater, preferably significantly greater, than the base tensile modulus.

In a non-limiting exemplary embodiment, the transition strain region may be in the range of fabric strains from 68% to 76% in a weft direction and from 0.765% to 0.855% in a warp direction. The maximum fabric elongation can be about 80% in a weft direction and 90% in a warp direction.

Preferably, the overstrain tensile modulus of the fabric 3 is greater than two times the base tensile modulus, preferably, the overstrain tensile modulus of the fabric 3 amounts to 3 . . . 5 times the base tensile modulus (compare FIG. 12).

By providing the reinforcement fibers, particularly carbon fibers 7 in the stretch fabric 3 of the swim suit 1, excessive forces are directed away from the remaining elastic fibers of the fabric 3, particularly from the comparatively wear sensitive Lycra® fibers and nylon material, and transmitted by the much stiffer reinforcement fibers. Experimental testing has shown that carbon reinforcement fibers woven into a nylon base fabric or a reinforced fabric woven from threads which are made of combined nylon and carbon fiber strands can reduce the wear rates by up to 50%-80% with respect to a nylon fabric without such reinforcement.

Carbon fibers 7 have an increased toughness, wear resistance and ultimate tensile strength and tensile modulus with respect to nylon fibers, such that in an intact shell 2 of the swim suit 1, the initial material properties such as the low drag surface properties and the reversible elastic stretch properties are maintained for a much longer time and, in an eventually worn out shell 2 of the swim suit 1, the carbon fibers continue to resist to the mechanical loads and prevent complete surface abrasion and ripping of the swim suit.

Moreover, the carbon fibers 7 are conductive and prevent the swim suit 1 from electrostatic discharges which are generally unwanted and which may otherwise occur when the athlete puts the dry swim suit on a dry body.

In accordance with an embodiment, the above described non-linear material properties of the fabric 3 and the reinforcement fibers, particularly carbon fibers 7, are provided in a region extended substantially over the entire outer shell 2 of the swim suit 1.

The fabric 3 may comprise twisted elastomer yarn, e.g. twisted Lycra® and/or Nylon multifilament yarn woven together with the reinforcement fibers, particularly carbon fibers 7.

The reinforcement fibers may be advantageously embodied as carbon added polyamide multifilament yarns. Such yarns can be easily weaved together with other elastomeric yarns of the fabric and are adapted to create together with the remaining polymeric yarn a desired low-drag and water repellent surface texture.

In a preferred embodiment, the base threads of the fabric are polyamide-Lycra® threads in which a polyamide fiber or fiber strand is twisted about a Lycra® core. The reinforcement threads are polyamide-carbon-Lycra® threads in which a polyamide fiber or fiber strand is coated with carbon and the carbon coated polyamide fiber or fiber strand is twisted about a Lycra® core.

The reinforcement threads are weaved in the fabric providing 1 warp reinforcement thread per each 54 warp steps and 2 weft reinforcement threads per each 43 weft steps.

Hence, in accordance with an embodiment, the weft direction 9 which corresponds to a hoop (or circumferential) direction 11 about the body trunk and about the legs of the swimmer, comprises a significantly greater amount of directional reinforcement, than the warp direction 8 which is oriented in a longitudinal body direction 10. Accordingly, in the overstrain range 6, the fabric 3 has a greater tensile stiffness in the weft direction 9 than in the warp direction 8.

The fabric 3 may further contain a plurality of micro-channels 12 adapted to let air pass through the fabric 3 and e.g. obtained by leaving out a predetermined number of weft threads for a given number of weft steps and by leaving out a predetermined number of warp threads for a given number of warp steps.

In a non-limiting exemplary embodiment four weft threads are left out per each 43 weft steps and four warp threads are left out per each 54 warp steps.

The micro channels 12 allow the fabric 3 to breath and avoid air bubble formation between the skin of the athlete and the outer shell 2 of the swim suit 1.

The weaving pattern of the fabric 3 may be preferably a double thread weaving in which the number of threads in warp direction (warp threads) is twice the number of threads in the weft direction (weft threads).

As shown in FIGS. 1 and 2 the warp 8 and weft 9 directions of the fabric 3 may be orthogonal to one another and, in the swim suit 1, the warp 8 and weft 9 directions may be oriented parallel with respect to a longitudinal body direction 10 (substantially parallel to the athletes spinal line and legs when in an upright posture) and to a circumferential body direction 11 perpendicular to the longitudinal body direction 10. Preferably, the warp direction 8 is oriented in a manner to be parallel to the longitudinal body direction 10 and the weft direction 9 is oriented in a manner to extend along the circumferential body direction 11 of the swimmer.

In accordance with a preferred embodiment, the weaving pattern of the fabric 3 is configured as Basketweave or Panama weave in which groups of warp 8 and weft 9 threads are interlaced so that they form a criss-cross pattern and each group of weft threads crosses a, preferably but not necessarily, equal number of warp threads by going over one group, then under the next, and so on. The next group of weft threads goes under the warp threads that its neighbor went over, and vice versa.

In accordance with a further embodiment, the swim suit 1 may comprise one or more elastically stretchable tapes 13 attached to (a preferably internal surface) of the outer shell 2 and adapted to provide localized energy accumulation and return during a swimming movement. While the present invention has been illustrated by description of several embodiments and while the illustrative embodiments have been described in considerable detail, it is not the intention to restrict or in any way limit the scope of the appended claims to such detail. Additional advantages and modifications may readily appear to those skilled in the art.

The invention claimed is:

1. Swim suit, particularly for competition swimming, comprising an outer shell suitable to cover at least part of the body trunk and of the legs of a swimmer, wherein the outer shell is made of a flexible stretchable fabric having, in at least a region of the outer shell, a non-linear tensile stress-strain behavior with:

a base strain range in which the tensile strain of the fabric is less than a transition strain value, and an overstrain range in which the tensile strain of the fabric is greater than the transition strain value, wherein a tensile modulus of the fabric in the overstrain range is greater than a tensile modulus of the fabric in the base strain range.

2. Swim suit according to claim 1, wherein in said region of the shell, additional reinforcement fibers are woven into the fabric in a multiple bent configuration such that:

in said base strain range, the reinforcement fibers can bend or straighten out without elongation and without substantially contributing to the tensile stiffness of the shell, in said overstrain range, the reinforcement fibers are elongated and contribute to and increase the tensile stiffness of the shell.

3. Swim suit according to claim 2, wherein said reinforcement fibers woven into the stretch fabric of the swim suit have a greater tensile stiffness than base fibers of which the fabric is made.

4. Swim suit according to claim 2, wherein the reinforcement fibres comprise carbon fibers distributed in and woven into the fabric in a manner that individual reinforcement fibres straighten out and undergo axial fiber strain at different overall strain values of the fabric, thereby determining a transition strain region in which the stretch stiffness of the fabric gradually changes from a base tensile modulus to an overstrain tensile modulus which is greater than the base tensile modulus.

5. Swim suit according to claim 1, wherein the overstrain tensile modulus of the fabric is greater than two times the base tensile modulus.

6. Swim suit according to claim 5, wherein the overstrain tensile modulus of the fabric amounts to 3 to 5 times the base tensile modulus.

7. Swim suit according to claim 1, wherein the fabric comprises base threads woven together with the reinforcement fibers, said base threads being formed by twisted multifilament elastomer yarn and said reinforcement fibers comprising carbon added polyamide multifilament yarns.

8. Swim suit according to claim 7, wherein the base threads of the fabric are polyamide-Lycra® threads in which a polyamide fiber or fiber strand is twisted about a Lycra® core, and the reinforcement threads are polyamide-carbon-Lycra® threads in which a polyamide fiber or fiber strand is coated with carbon and the carbon coated polyamide fiber or fiber strand is twisted about a Lycra® core.

9. Swim suit according to claim 8, wherein the reinforcement threads are weaved in the fabric such that 1 warp reinforcement thread is provided per each 54 warp steps and 2 weft reinforcement threads are provided per each 43 weft steps.

10. Swim suit according to claim 1, in which the weft direction of the fabric is oriented along a hoop direction about the body trunk and about the legs of the wearer of the swim suit, and the warp direction of the fabric is oriented in a longitudinal body direction of the wearer of the swim suit, wherein the fabric comprises a greater amount of directional reinforcement fibers in the weft direction than in the warp direction and has, in the overstrain range, a greater tensile stiffness in the weft direction than in the warp direction.

11. Swim suit according to claim 1, in which said fabric forms a plurality of micro-channels adapted to let air pass through the fabric.

12. Swim suit according to claim 1, comprising one or more elastically stretchable tapes attached to an internal surface of the outer shell.

13. Swim suit, according to claim 1, wherein, in at least a region of the outer shell, carbon fibers are woven into the fabric.

14. Swim suit, particularly for competition swimming, comprising an outer shell suitable to cover at least part of the body trunk and of the legs of a swimmer, wherein the outer shell is made of a flexible stretchable fabric having reinforcement threads and base threads, the base threads being woven together with the reinforcement threads, said base threads being polyamide-Lycra® threads comprising a Lycra® core and a polyamide fiber or fiber strand twisted about the Lycra® core, and said reinforcement threads being polyamide-carbon-Lycra® threads comprising a Lycra® core and a polyamide fiber or fiber strand coated with carbon and twisted about the Lycra® core.

* * * * *